US005800959A

United States Patent [19]

Ikami

[11] Patent Number: 5,800,959

[45] Date of Patent: Sep. 1, 1998

[54] ELECTROSTATIC LATENT IMAGE DEVELOPER

[75] Inventor: Jun Ikami, Nagoya, Japan

[73] Assignee: Brother Kogyo Kabushiki Kaisha, Nagoya, Japan

[21] Appl. No.: 665,299

[22] Filed: Jun. 17, 1996

[30] Foreign Application Priority Data

Jul. 13, 1995 [JP] Japan ..... 7-177468

[51] Int. Cl.[6] ..... G03G 13/18; G03G 9/08

[52] U.S. Cl. ..... 430/126; 430/110; 430/111; 430/903

[58] Field of Search ..... 430/903, 110, 430/111, 126

[56] References Cited

U.S. PATENT DOCUMENTS

| | | | |
|---|---|---|---|
| 4,816,365 | 3/1989 | Ishikawa | 430/111 |
| 5,041,351 | 8/1991 | Kitamori et al. | 430/110 |
| 5,272,040 | 12/1993 | Nakasawa et al. | 430/110 |
| 5,429,901 | 7/1995 | Muto et al. | 430/110 |

FOREIGN PATENT DOCUMENTS

| | | | |
|---|---|---|---|
| 0617336 | 9/1994 | European Pat. Off. | 430/110 |
| 2-90175 | 3/1990 | Japan | 430/110 |
| 4-172364 | 6/1992 | Japan . | |
| 4-280254 | 10/1992 | Japan . | |
| WO-18908 | 10/1992 | WIPO | 430/111 |

OTHER PUBLICATIONS

Patent & Trademark Office English Translation of JP 2-90175 (Pub. 3/90), Mar. 1990.

Caplus Abstract AN:1994:334907 (1994) of JP 53-13406 (pub. Nov. 26, 1993).

*Primary Examiner*—Janis L. Dote
*Attorney, Agent, or Firm*—Oliff & Berridge, PLC

[57] ABSTRACT

An electrostatic latent image developer is produced by adding 1 part by weight or more of an agent improving transfer efficiency, the agent having an average particle size of 0.1 to 3 μm, together with 0.3 to 5 parts by weight of a hydrophobic silica fine powder of a BET specific surface area of 50 to 300 $m_2/g$ to 100 parts by weight of a toner. The electrostatic latent image developer of the invention improves the transfer efficiency from a photosensitive material onto a recording medium while the flowability of the toner can be retained, whereby any cleaning mechanism in a developer system can be omitted.

11 Claims, 1 Drawing Sheet

ELECTROSTATIC LATENT IMAGE DEVELOPER

BACKGROUND OF THE INVENTION

1. Field of the Invention

The invention relates to an electrostatic latent image developer, and more specifically, the invention relates to a novel electrostatic latent image developer mainly applicable to electrophotography and electrostatic recording for printers, facsimiles, copying machines, plotters and the like.

2. Description of Related Art

The process of developing electrophotographs is generally divided broadly into a one-component developing process and a two-component developing process. The one-component developing process is singly composed of a toner developed on an electrostatic latent image on a photosensitive material. Alternatively, the two-component developing process is composed of a developing toner and a carrier capable of efficiently charging the toner. The two-component developing process is carried out at a mixing ratio of 95 to 98% by weight of a carrier and 2 to 5% by weight of a toner. The toner is a non-magnetic type. When the mixing ratio of the toner is 5% by weight or more, fogging may occur due to deposition of the toner at a non-printed part, with the consequence of deterioration of the image quality.

A process by means of a magnetic toner at an elevated mixing ratio thereof has been proposed. Because the process is an eclectic process between the one-component developing process and the two-component developing process, the process is referred to as a 1.5-component developing process. According to the 1.5-component developing process, the developer is composed of a mixing ratio of 30 to 80% by weight of a carrier and 20 to 70% by weight of toner.

As has been described above, the carrier and the like in a two-component developer or a 1.5-component developer assist with charging of the toner, so that the toner therein has a relatively low charge retention. When the developed toner is to be transferred onto a recording medium, therefore, an electrostatic attraction force (namely, the so-called image force) above the required level will not work between the toner and the photosensitive material. Thus, the toner on the photosensitive material is nearly totally transferred onto the recording medium. Additionally, it is possible to remove the residual toner on the photosensitive material by means of the carrier on a carrying roller. It is possible to either realize a system without any toner cleaning mechanism or to simplify the cleaning process in the systems for the two-component developing process and 1.5-component developing process, which are likely to be made into a compact type device.

However, the abolition of any cleaning process or the achievement of such simplification may involve difficult problems according to the one-component developing process.

Firstly, the one-component developing process is grouped into two types by the use of magnetic toners and non-magnetic toners. Both types of the process comprise forming a thin layer of a toner on the surface of a carrying roller, transferring the toner onto a photosensitive material with an electrostatic image formed thereon, and bringing the thin layer into contact with the photosensitive material to guide and develop the toner on the electrostatic latent image, and to subsequently transfer the toner onto a recording medium. According to the developing process, the toner on the carrying roller is charged through collisions between the toner particles during the operation of an agitator or through the contact of the particles with a blade during the preparation of thin layers, so that the toner may be prepared into a thin layer with the blade and the like. Thus, no charge assisting occurs with a carrier or the like. Hence, it is required that the toner should have a potency to retain the charges derived from frictional charging until the development step. Thereafter, the toner is developed on the electrostatic latent image on the photosensitive material, which is then developed on the recording medium by means of a transferring device.

Because the charge retention of the toner is high with the one-component developing process, the image force works between the toner and the photosensitive material when the developed toner is to be transferred onto the recording medium. Consequently, the toner may remain on the photosensitive material with no transfer thereof onto the recording medium.

Therefore, it is necessary to reduce the charge retention of the toner. Because the non-magnetic toner for the one-component developing process does not contain any magnetic powder, however, the charge retention of such toner remains relatively high. In an effort to counter this effect, a magnetic one-component developing process is suggested, wherein a conductive material such as magnetic powder is contained in a toner mostly occupied with a toner binder so as to reduce the image force between the toner and a photosensitive material. From the respect of fixing a toner image on a recording medium, it is impossible to increase the content of the magnetic powder so as to markedly decrease the content of the toner binder. Additionally, because the volume resistance of toner binders is far greater than the volume resistance of magnetic powders, the charge retention of any toner should be limited. Toner binders function as a binder to bind together a variety of ingredients contained in toners, and thus the binders melt thermally during the fixing so as to be bound to a recording medium.

Even if the charge retention of a toner can be markedly reduced without regard to the fixability of the toner, the charge of the toner may be lowered to an insufficient level before the developed toner is transferred onto a recording medium. In such a case, the interior of a part to be printed is not transferred, causing the part to be printed as if the part was fringed. In other words, so-called printing except inside, or missing middle, occurs. Furthermore, a serious case may occur in which almost no transfer occurs.

Japanese unexamined Patent Publications 4-172364 (1992) and 4-280254 (1992), describe a process of producing an electrostatic latent image developer to improve the charge stability and cleanability of the toner, comprising adding a given ratio of external additives, namely an acrylic polymer in a fine powdery preparation, and silica powder or an alumina fine powder subjected to hydrophobic treatment, to a toner particle containing a toner binder and a coloring agent.

In recent years, however, cleaning processes have been likely to be omitted, so a higher transferring efficiency of a toner onto a recording medium is inevitable. As will be described below in Comparative Example 3, the electrostatic latent image developer with the composition described in Japanese unexamined Patent Publication 4-172364 and 4-280254 can overcome drawbacks such as poor cleanability and the occurrence of toner filming, a phenomenon wherein a toner may adhere more or less to a photosensitive material, but the transferring efficiency of a toner onto a recording medium cannot be improved. So as to provide a toner with a good transferring efficiency, therefore, it is essential to adjust the properties in a developing system, such as charge, volume resistance, and charge retention and to thereafter maintain the adjusted properties. Thus, attempts have been made to modify these performance properties by means of toner components including resins, coloring agents, mold releasing agents and charge control agents, thereby improving the transferring efficiency, but the improvement thereof cannot be attained yet.

SUMMARY OF THE INVENTION

The invention has been carried out so as to overcome the aforementioned problems. An object of the invention is to provide an electrostatic latent image developer having good flowability and causing less fogging at a higher transferring efficiency, with no requirement for any cleaning mechanism.

So as to attain these and other objects, the electrostatic latent image developer of the invention is characterized in that the toner itself contains an agent improving the transferring efficiency, and optionally an agent providing flowability.

For the agent improving the transfer efficiency in the electrostatic latent image developer of the invention, use may be made of an acrylic polymer fine powder, a vinyl polymer fine powder, a styrene polymer fine powder, a copolymer of two or more types of the monomers used as the starting materials for generating these polymeric fine powders, or a mixture of two or more types thereof, whereby the transfer efficiency can be improved remarkably.

The surface of the fine powders may be charged at a desired level by using an agent improving the transfer efficiency in which the surface of the agent has been preliminarily treated with a metal salt. By doing so, the amount of adversely charged toner may be reduced with no deposition of the toner on a non-printed part of a photosensitive material, whereby the fogging phenomenon can be suppressed.

BRIEF DESCRIPTION OF THE DRAWING

A preferred embodiment of the invention will be described below in detail with reference to the following FIGURE wherein:

The FIGURE is an explanatory view depicting the configuration of the main elements of a laser beam printer using an electrostatic latent image developer of the invention.

DETAILED DESCRIPTION OF PREFERRED EMBODIMENTS

Figure 1:
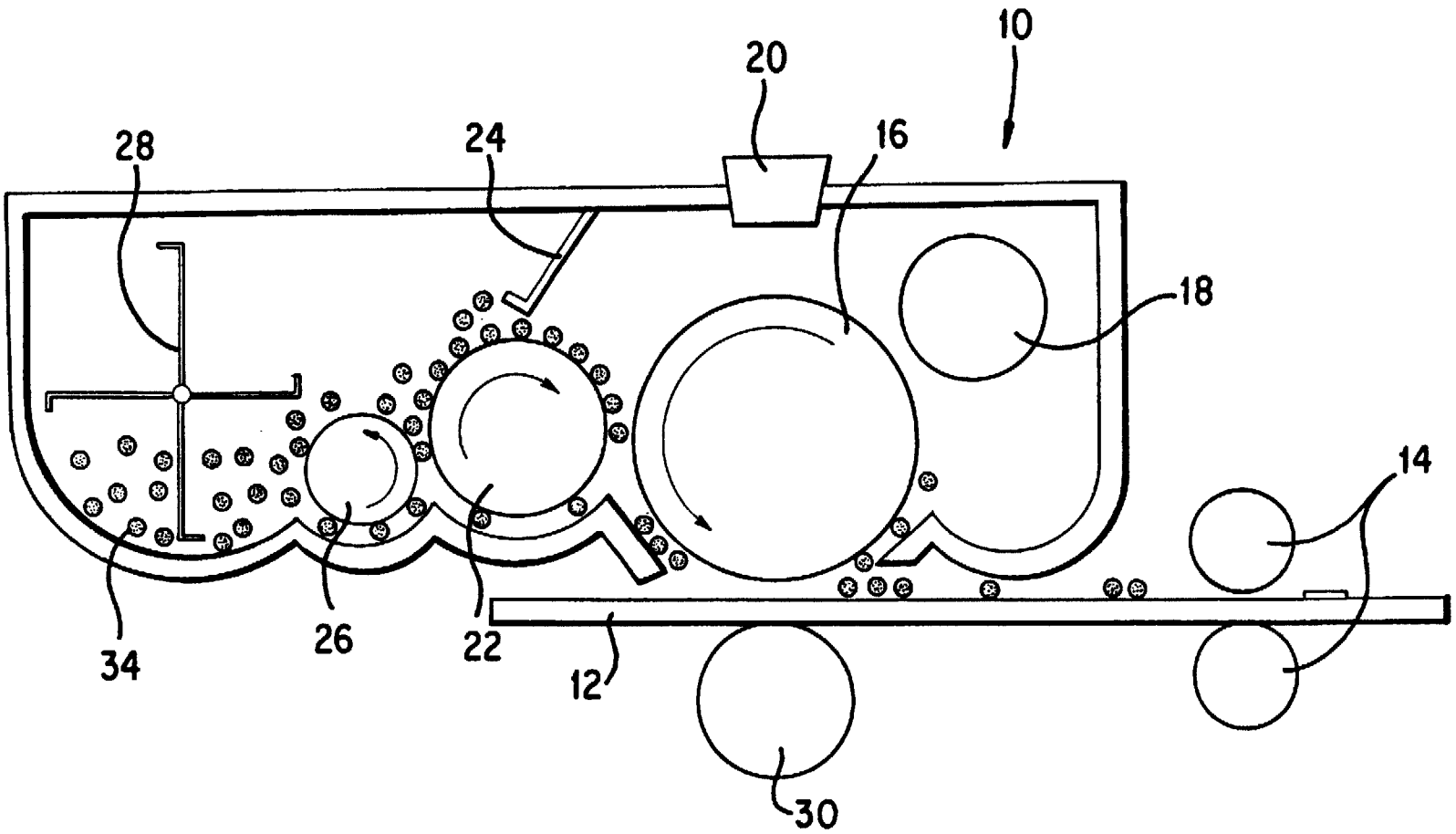

The electrostatic latent image developer of the invention will be described below. The electrostatic latent image developer of the invention is applicable to printing processes for developing electrostatic latent images, such as an electrophotographic process and an electrostatic recording process. With reference to the Figure, the developing principle of a printing processes wherein a non-magnetic one-component developer as the electrostatic latent image developer is placed in a laser printer will be described.

Firstly, the laser beam printer illustrated comprises a developing device 10 for the processes of accumulation, charging, developing, transferring and the like of a toner, and a thermal fixing device 14 for fixing a toner image on a recording medium 12 through thermal melting.

The developing device 10 is removable from the laser beam printer and includes a charging roller 18 located on the periphery of a photosensitive material 16, in this case an electrically conductive aluminum cylinder coated with a photoconductive layer. The roller 18 provides a surface potential to the photosensitive material 16. The photosensitive material 16 may also be of any suitable form known in the art, such as a drum or belt. The developing device 10 also includes a laser scanner 20 providing image information, a carrying roller 22 for carrying a toner to transfer the toner onto an electrostatic latent image on the photosensitive material 16, a blade 24 controlling the toner on the carrying roller 22 so that the toner may be in a uniform thin layer, a feed roller 26 supplying the toner to the carrying roller 22, an agitator 28 agitating the toner in accumulation so that the toner might maintain its good flowability, and a transfer roller 30 transferring a toner visible image formed on the photosensitive material 16 onto the recording medium 12 such as a paper sheet or plastic film.

In accordance with the invention, the electrostatic latent image developer 34 is placed in the developing device 10, which is then agitated with the agitator 28 and then brought into contact with the feed roller 26. A bias, for example of −400 V (volt), is applied to the feed roller 26, while a bias, for example of −300 V, is applied to the carrying roller 22. Therefore, following the rotational movement of the feed roller 26 along with the carrying roller 22 in the direction shown by the arrow, the electrostatic latent image developer 34 is fed from the feed roller 26 onto the carrying roller 22, where the developer is prepared into a thin layer by means of the blade 24.

A voltage, for example of about 1.4 kV, is applied to the charging roller 18, to provide a surface potential, for example of about −900 to −1000 V, on the photosensitive material 16. Irrespective of whether the charging roller is in contact or not in contact with the photosensitive material, the charging roller 18 may take a form other than the shape of roller. As the charging roller 18, use may be made of various members such as a scorotron providing a given surface potential to the photosensitive material 16 via corona discharge, a semiconductive brush in contact with the photosensitive material 16 to give a surface potential, or a blade member.

Image information transformed into electric signals is supplied as optical signals from the laser scanner 20 to the photosensitive material 16 provided with the surface potential via the charging roller 18, and the potential at a portion of the photosensitive material 16 exposed to the laser beam is decreased via the action of the photoconductive layer, thus forming an electrostatic latent image with a different potential distribution on the photosensitive material. As a means for supplying the image information as optical signals onto the photosensitive material 16 a laser scanner 20 is illustrated, but any other suitable means including LED may be used besides the laser scanner 20.

On contact with the photosensitive material 16, the electrostatic latent image developer 34 prepared into a thin layer by means of the blade 24 and transferred by the carrying roller 22 is singly developed on the electrostatic latent image formed on the photosensitive material 16. As discussed above, the electrostatic latent image on the photosensitive material 16 is formed through the decrease of the potential, for example to −50 V, at a portion of the photosensitive material 16 exposed to the laser beam from the laser scanner 20, where the surface potential provided from the charging roller 18 is at, for example, −900 to −1000 V. A bias potential of, for example, −300 V is applied to the carrying roller 22, to develop the electrostatic latent image developer 34 with negative charges at the portions of the photosensitive material 16 at the potential of −50 V. As to the chargeability of the electrostatic latent image developer 34, the electrostatic latent image developer 34 is negatively charged in this example. The developer may also be positively charged provided that the potentials of the individual members are put at their opposite polarity.

By regulating the visual image of the electrostatic latent image developer 34 formed on the photosensitive material 16 to a constant electric current, for example of 3 μA, transferring the image onto the recording medium 12 by using the transfer roller 30 having positive polarity under control, and fixing the electrostatic latent image developer 34 on the recording medium 12 by means of the thermal fixing device 14, an objective image can be recorded on the recording medium 12. The thermal fixing device may be of the non-contact type, utilizing an electric field, for example as is the case with a scorotron. The device may also be of the contact type, using, for example, a roller, a brush, a blade or the like.

The components of the electrostatic latent image developer 34 will now be described.

Firstly, the toner of the developer comprises a toner binder or adhesive resin, pigment, an optional mold releasing agent, an optional charge control agent and the like.

As the toner binder, use may be made of, for example, polystyrene, polyacrylate, polymethacrylate, a vinyl-series resin, a polyester resin, polyethylene, polypropylene, polyvinyl chloride, polyacrylonitrile, polyether, polycarbonate, a cellulose-series resin, an epoxy-series resin, polyamide and a copolymer of the monomers as the structural components of these resins or a mixture of a plurality of the monomers.

If a negative charge toner is used, as in the examples below, preference is given to a polyester resin including a carboxyl group as the terminal functional group and being rigid in terms of hardness.

As the pigment, carbon black is preferred, although any pigment suitably used in toner compositions may be used. For example, known pigments can be used such as carbon black, cadmium red, molybdenum red, chromium yellow, cadmium yellow, titanium yellow, chromium oxide, viridian, titanium cobalt green, ultramarine blue, prussian blue, cobalt blue, azo pigment, phthalocyanine pigment, quinacridone pigment, isoindolinone pigment, dioxazine pigment, threne pigment, perylene pigment, perynone pigment, thioindigo pigment, quinophthalone pigment, and metal complex pigment. The pigments may be used in combination. For the preferred carbon black pigment, use may be made of furnace black, ketjen black, lamp black, thermal black, channel black and the like known in the art, which may be used singly or in combination.

Preference is given to a type of carbon black with a small specific surface area and a higher oil absorption potency, particularly a type of carbon black having a ratio of the BET specific surface area thereof to the oil absorption level (ml/100 g) at 0.8 or less. Furnace black in particular may satisfy the above described provisions.

As the mold releasing agent, polyalkylene or a natural wax may be mixed with the toner, including, for example, polyethylene, polypropylene, carnauba wax, candelilla wax, rice wax and the like.

The charge control agent includes, for example, nigrosine-series dyes, tetra-ammonium salts, alkoxylated amines, alkylamides, metal complexes of azo dyes, and metal salts of higher fatty acids. Other suitable charge control agents known in the art may also be used.

The additives for the electrostatic latent image developer 34 in accordance with the invention will now be described. The electrostatic latent image developer of the invention is characterized in that the toner itself contains an agent improving the transferring efficiency and also preferably an agent providing flowability. These agents are preferably present on the outer surface of the toner particles.

In one embodiment, by adding 1 part by weight or more of an agent improving the transferring efficiency having an average particle size of about 0.1 to about 3 μm, together with about 0.3 to about 5 parts by weight of a hydrophobic silica fine powder as the agent providing flowability and having a BET specific surface area (surface area determined by measuring the amount of nitrogen molecules adsorbed on a sample surface according to the BET adsorption isotherm or Brunauer-Emmett-Teller equation) of 50 to 300 $m^2/g$, to 100 parts by weight of a toner of in the electrostatic latent image developer of the invention, the charge retention potency of the toner is reduced by lowering the electric volume resistance of the toner. Because the agent improving the transfer efficiency can form a thin-layer film on a photosensitive material with an electrostatic latent image formed thereon, additionally, the image force between the toner and the photosensitive material can be weakened to readily transfer the toner onto a recording medium, whereby the transfer efficiency can be improved remarkably, while also permitting any cleaning mechanism to more readily be omitted.

In a preferred embodiment, the agent improving the transfer efficiency is added in an amount of about 1 to about 10 parts by weight to 100 parts by weight of the toner of the electrostatic latent image developer.

In another embodiment, by adding about 0.1 to about 1 part by weight of an aluminum oxide fine powder as the agent providing flowability and having an average particle size of 8 to 18 nm and/or 0.3 to 10 μm, together with 1 part by weight or more of an agent improving the transfer efficiency with an average particle size of 0.1 to 3 μm, to 100 parts by weight of the toner itself in the electrostatic latent image developer in accordance with the invention, the volume resistance of the toner can be lowered, whereby the charge retention potency thereof can be reduced.

In another embodiment, the silica fine powder and aluminum oxide fine powder may both be added to the toner as the agent providing flowability.

An agent improving the transfer efficiency of the toner is produced by adding and dispersing one or two or more monomers, for example from the group of an acrylic monomer, a styrene-series monomer and a vinyl-series monomer, into water along with, for example, completely saponified polyvinyl alcohol, thereafter emulsion polymerizing the resulting dispersion to prepare a polymer particle, adding a specific salt of metal such as, for example, calcium, zinc, aluminum, cobalt, nickel, chromium, manganese, and magnesium with formic acid, acetic acid, propionic acid or the like to the dispersion, and thereafter melting and agitating the dispersion prior to the removal of water.

As the starting material of the polymer particle, the following various monomers are preferred. The acrylic monomers include alkyl methacrylates such as, for example, methyl methacrylate, ethyl methacrylate, butyl methacrylate, and lauryl methacrylate; hydroxyalkyl methacrylates such as, for example, 2-hydroxymethyl methacrylate and 2-hydroxypropyl methacrylate; methacrylate monoesters of polyhydric alcohols such as, for example, trimethylol propane mono-methacrylate and trimethylol ethane mono-methacrylate; methacrylates of polyalkylene glycols such as, for example, polyethylene glycol mono-methacrylate and polypropylene glycol mono-methacrylate; dialkylaminoalkyl methacrylates such as, for example, diethylaminoethyl methacrylate; methacrylamide; and glycidyl methacrylate. Also, use may be made of the monoesters of the hydroxyalkyl methacrylate described above and the alkyl ethers of the aforementioned methacrylate monoesters of polyhydric alcohols.

The styrene-series monomer includes alkylstyrenes such as, for example, styrene, methylstyrene, dimethylstyrene, trimethylstyrene, ethylstyrene, diethylstyrene, triethylstyrene, propylstyrene, butylstyrene, hexylstyrene, heptylstyrene, and octylstyrene; halogenated styrenes such as, for example, fluorostyrene, chlorostyrene, bromostyrene, dibromostyrene, and iodostyrene; nitrostyrene; acetylstyrene; and methoxystyrene.

The vinyl-series monomer includes vinyl pyridine, vinyl pyrrolidone, vinyl carbazole, divinyl benzene, vinyl acetate, acrylonitrile, conjugated diene monomers such as, for example, butadiene, isoprene and chloroprene, halogenated vinyls such as, for example, vinyl chloride, vinyl bromide, vinylidene chloride and vinylidene bromide, and vinylidenes.

The specific metal salt serves as a charge control agent. Preferably, the specific metal salt includes, for example, calcium formate, zinc formate, tin formate, aluminum formate, cobalt formate, nickel formate, chromium formate, manganese formate, magnesium formate, calcium acetate, zinc acetate, tin acetate, aluminum acetate, cobalt acetate, nickel acetate, chromium acetate, manganese acetate, magnesium acetate, calcium propionate, zinc propionate, tin propionate, aluminum propionate, cobalt propionate, nickel propionate, chromium propionate, manganese propionate, and magnesium propionate. These specific metal salts are water-soluble substances.

Completely saponified polyvinyl alcohols are used as dispersion stabilizers of oil-in-water emulsions; and such alcohols are well-known materials used as water-soluble adhesives. Completely saponified polyvinyl alcohols serve as dispersion stabilizers for emulsion polymerizing the aforementioned specific monomers in water, and also as binders coating the surface of the resulting polymer particle with a specific metal. Other materials capable of serving such a dual function are also suitable.

A method for producing an agent improving the transfer efficiency is not limited, and includes an infinite number of methods other than the method described above. For example, a method comprising chemical reactions such as soap-free polymerization, dispersion polymerization and suspension polymerization to generate polymer particles in spherical shapes and a method comprising grinding polymerized masses to recover fine powders are also possible. Additives therefor may vary depending on the method as would be understood by one of skill in the art. Furthermore, a method with no treatment with the metal salts may also be suitable.

The agent improving the transfer efficiency is effective for improving the releasability of the toner from the photosensitive material 16 through the deposition of the agent as a thin layer on the surface of the photosensitive material. Additionally, if the agent improving the transfer efficiency is surface treated with a metal salt to adjust the charge, the charge distribution on the toner may be sharp and stabilized so that the toner is readily transferred onto an electrostatic latent image on the photosensitive material 16, with no deposition of the toner at portions where no printing is desired. Because the toner volume resistance is reduced to weaken the charge retention thereof, the image force between the toner and the photosensitive material 16 is reduced so that the toner is readily transferable onto the recording medium 12 with the resultant improved transfer efficiency.

As the agent providing flowability to the toner, preferably added along with the agent improving the transfer efficiency, a hydrophobic silica fine powder is preferred, preferably present on the outer surface of the toner particles. Preferably, the hydrophobic silica fine powder has a BET specific surface area within a range of 50 to 300 $m^2/g$ for providing the toner flowability. Also, the silica fine powder may be preferably surface treated with silicones having a silyl group such as, for example, aminosilane, trimethylsilane, dimethylsilane and octylsilane. By using these fine powders of silica, any decrease in the flowability caused by the agent improving the transfer efficiency can be prevented.

The fine powders of silica treated with a surface treating agent are effective for environmental stability. The fine powders of silica exert their effects after the deposition thereof on the toner particle surface. More specifically, the silica fine powder adheres to the toner surface to serve as a roller to improve the flowability and avoid stress on the toner.

If a fine powder of silica is below a specific surface area of 50 $m^2/g$, the fine powder of silica may not satisfactorily disperse in the toner, so that the powder may not adequately deposit on the toner surface. Thus, such powder may not be able to exert its effect of providing flowability to the toner.

When a silica powder with a specific surface area of more than 300 $m^2/g$ is mixed with the toner to be deposited onto the toner surface, although the deposit is not in the form of multiple layers, the toner may be put to contact to each other, with the consequence of possibly unsatisfactory improvement in the flowability.

When the silica powder adheres to the toner surface in the form of multiple layers, the silica powder may not serve as a roller, so that the effect of the silica may not be exerted. When a silica fine powder has a BET specific surface area within a range of 50 to 300 $m^2/g$, the silica fine powder can work as a roller, thereby sufficiently exerting the effect thereof as an agent providing flowability.

It is preferred that the particle shape of silica is spherical. If the particle shape is not constant, the silica particle may serve less efficiently as a roller between the toners.

Furthermore, an aluminum oxide fine powder which may be added to the toner particle serves as a polishing agent to polish the deposits on the photosensitive material 16 while also possibly serving as an agent providing flowability to enhance the toner flowability. Preferably, the fine powder of aluminum oxide has less frictional charge than the toner particle but the powder has a higher hydrophobicity.

An aluminum oxide fine powder of an average particle size of about 0.1 to 60 μm works as a polisher. However, as the aluminum oxide particle size increases, the effectiveness as an agent providing flowability may decrease. An aluminum oxide fine powder of an average particle size of 0.3 to 10 μm is more preferable.

Additionally, even a particle with a specific surface area such as that of the silica can function as a polisher, and an aluminum oxide fine powder of an average particle size of 8 to 18 nm is advantageous for the exertion of the polishing effect and the effect of providing flowability.

The toner developed on the photosensitive material 16 is transferred onto the recording medium 12 by means of the transfer roller 30, but 100% of the toner is not transferred onto the recording medium 12 so some of the toner remains on the photosensitive material 16. The residual toner is pressed onto the photosensitive material 16 by means of a roller in press contact with the photosensitive material 16, to deposit the toner on the photosensitive material 16. Once the toner adheres to the photosensitive material 16, the toner deposit grows in a larger mass. Consequently on an image sample, an initially small black spot may grow into a larger spot over the course of printing. The aluminum fine powder functions to peel the toner deposit off the photosensitive material 16 before its growth.

Specific examples of the electrostatic latent image developer 34 of the invention will now be described in detail.

EXAMPLES

First, the method for producing the toner will be described below. The toner composition is as follows.

- Polyester resin (FC-701, manufactured by Mitsubishi Rayon Co., Ltd.): 100 parts by weight
- Carbon black (#44, manufactured by Mitsubishi Chemical Corporation): 13 parts by weight
- Wax (Biscol 660P, manufactured by Sanyo Chemical Industries, Ltd.): 5 parts by weight
- Charge control agent (Bontron S-34, manufactured by Orient Chemical Industries, Ltd.): 2 parts by weight.

These materials are mixed together in their powdery state, and the carbon black, wax and charge control agent are dispersed therein, under heating, by means of a kneading extruder. After cooling the heated and kneaded materials, the resulting mixture is crudely ground and subsequently finely ground to prepare toner particles of a particle size on the order of several micrometers. Further, the particles are prepared into powdery particles of a particle size of 3 to 20 μm by means of a pneumatic classifier.

The method for producing the electrostatic latent image developer 34 will be now described.

As shown in the examples below, 100 parts by weight of the resulting toner particles are mixed with the acrylic fine powder as an agent improving the transfer efficiency and either one of a hydrophobic silica fine powder, an aluminum oxide fine powder or a combination of the hydrophobic silica fine powder and the aluminum oxide fine powder, as the agent providing flowability, and the resulting mixture is then agitated with a Henschel mixer, to generate a dry-type toner, namely an electrostatic latent image developer, with the additive agents on the surface of the toner particles.

Preferably, the agent improving the transfer efficiency is surface treated with a metal salt. In the following examples, the metal salt used for surface treatment is MP1451 manufactured by Soken Chemical Engineering Company Limited.

The electrostatic latent image developer 34 (15 g) is placed in the developing device 10 and image output is conducted. For the image output, an image is developed on the photosensitive material 16 by means of the developing device 10, which is then transferred onto a piece of standard sheet as the recording medium 12 by means of the transfer roller 30 to fix the toner on the sheet by means of the thermal fixing device 14.

As the recording medium, use is made of a type of sheet, 4024 (20 pounds), manufactured by Xerox Corporation, for printing.

At an intermediate stage during the printing operation before the transfer operation is completely finished, the operation of the device is stopped in order to measure the amount of the toner remaining on the photosensitive material 16 after transfer to the recording medium 12. The method for such measurement comprises measuring the residual toner on the photosensitive material 16 after the transferring operation, and calculating the percentage of the residual toner to the toner amount on the photosensitive material 16 before the transferring operation, and the percentage is used as an indicator of the transferring efficiency.

Furthermore, the printing fog on the recording medium 12 is determined by measuring the whiteness of the recording medium 12 with no printing by means of a reflect meter of Model TC-6MC manufactured by Tokyo Denshoku Co., Ltd., and calculating the difference in whiteness between the recording medium 12 after printing and the recording medium with no printing. The difference is used as a fogging indicator. Therefore, a smaller value of difference in whiteness indicates less fogging on the recording medium 12.

As a standard electrostatic latent image developer, experiments are conducted using a developer produced by adding externally to the above toner particle only a hydrophobic silica of a particle size of 10 to 20 nm, without external addition of an agent improving the transfer efficiency. The results of the measurement in this case are as follows; the transfer efficiency was 62%, and the fogging index was 1.81.

Example 1

One part by weight of an agent improving the transfer efficiency, namely a polymethyl methacrylate fine powder surface treated with a metal salt and having an average particle size of 0.15 μm and 1 part by weight of a hydrophobic silica fine powder of an average particle size of 10 to 20 nm, are mixed with 100 parts by weight, before the external addition, of the toner particle of the composition described above, followed by agitation with a Henschel mixer to prepare a developer. Subsequently under the conditions described above, printing is done onto the recording medium 12 to measure the transfer efficiency and the fogging index.

Results of measurement

Transfer efficiency: 83%

Fogging index: 0.75

Example 2

Three parts by weight of an agent improving the transfer efficiency, namely a polymethyl methacrylate fine powder surface treated with a metal salt and having an average particle size of 0.15 μm and 1 part by weight of a hydrophobic silica fine powder of an average particle size of 10 to 20 nm, are mixed with 100 parts by weight, before the external addition, of the toner particle of the composition described above, followed by agitation with a Henschel mixer to prepare a developer. Subsequently under the conditions described above, printing is done onto the recording medium 12 to measure the transfer efficiency and the fogging index.

Results of measurement

Transfer efficiency: 88%

Fogging index: 0.72

Example 3

Five parts by weight of an agent improving the transfer efficiency, namely a polymethyl methacrylate fine powder surface treated with a metal salt and having an average particle size of 0.15 μm and 1 part by weight of a hydrophobic silica fine powder of an average particle size of 10 to 20 nm, are mixed with 100 parts by weight, before the external addition, of the toner particle of the composition described above, followed by agitation with a Henschel mixer to prepare a developer. Subsequently under the conditions described above, printing is done onto the recording medium 12 to measure the transfer efficiency and the fogging index.

Results of measurement

Transfer efficiency: 93%

Fogging index: 0.60

Example 4

Ten parts by weight of an agent improving the transfer efficiency, namely a polymethyl methacrylate fine powder surface treated with a metal salt and having an average particle size of 0.15 μm and 1 part by weight of a hydrophobic silica fine powder of an average particle size of 10 to 20 nm, are mixed with 100 parts by weight, before the external addition, of the toner particle of the composition described above, followed by agitation with a Henschel mixer to prepare a developer. Subsequently under the conditions described above, printing is done onto the recording medium 12 to measure the transfer efficiency and the fogging index.

Results of measurement

Transfer efficiency: 95%

Fogging index: 0.58

Example 5

Three parts by weight of an agent improving the transfer efficiency, namely a polymethyl methacrylate fine powder surface treated with a metal salt and having an average particle size of 0.15 μm, 0.2 part by weight of an aluminum oxide fine powder of an average particle size of 2.6 to 3.4 μm, and 1 part by weight of an aluminum oxide fine powder of an average particle size of 13 nm (RFY-C, manufactured by Nippon Aerosil Co., Ltd.), are mixed with 100 parts by weight, before the external addition, of the toner particle of the composition described above, followed by agitation with a Henschel mixer to prepare a developer. Subsequently under the conditions described above, printing is done onto the recording medium 12 to measure the transfer efficiency and the fogging index.

Results of measurement

Transfer efficiency: 85%

Fogging index: 0.61

Example 6

Three parts by weight of an agent improving the transfer efficiency, namely a polymethyl methacrylate fine powder surface treated with a metal salt and having an average particle size of 0.15 μm, 1 part by weight of a hydrophobic silica fine powder of an average particle size of 10 to 20 nm, and 0.5 part by weight of an aluminum oxide fine powder of an average particle size of 2.6 to 3.4 μm are mixed with 100 parts by weight, before the external addition, of the toner particle of the composition described above, followed by agitation with a Henschel mixer to prepare a developer. Subsequently under the conditions described above, printing is done onto the recording medium 12 to measure the transfer efficiency and the fogging index.

Results of measurement

Transfer efficiency: 88%

Fogging index: 0.53

Example 7

Three parts by weight of an agent improving the transfer efficiency, namely a polymethyl methacrylate fine powder surface treated with a metal salt and having an average particle size of 0.4 μm and 1 part by weight of a hydrophobic silica fine powder of an average particle size of 10 to 20 nm, are mixed with 100 parts by weight, before the external addition, of the toner particle of the composition described above, followed by agitation with a Henschel mixer to prepare a developer. Subsequently under the conditions described above, printing is done onto the recording medium 12 to measure the transfer efficiency and the fogging index.

Results of measurement

Transfer efficiency: 83%

Fogging index: 0.70

Example 8

Three parts by weight of an agent improving the transfer efficiency, namely a polymethyl methacrylate fine powder surface treated with a metal salt and having an average particle size of 0.8 μm and 1 part by weight of a hydrophobic silica fine powder of an average particle size of 10 to 20 nm, are mixed with 100 parts by weight, before the external addition, of the toner particle of the composition described above, followed by agitation with a Henschel mixer to prepare a developer. Subsequently under the conditions described above, printing is done onto the recording medium 12 to measure the transfer efficiency and the fogging index.

Results of measurement

Transfer efficiency: 90%

Fogging index: 0.52

Example 9

Three parts by weight of an agent improving the transfer efficiency, namely a polymethyl methacrylate fine powder surface treated with a metal salt and having an average particle size of 1.5 μm and 1 part by weight of a hydrophobic silica fine powder of an average particle size of 10 to 20 nm, are mixed with 100 parts by weight, before the external addition, of the toner particle of the composition described above, followed by agitation with a Henschel mixer to prepare a developer. Subsequently under the conditions described above, printing is done onto the recording medium 12 to measure the transfer efficiency and the fogging index.

Results of measurement

Transfer efficiency: 80%

Fogging index: 0.32

In the above examples, all the transfer efficiencies are 80% or more, while all the fogging indices are 0.75 or less. Compared with the developers to which no agent improving the transfer efficiency, such as an acrylic fine powder and the like, has been added, remarkable effects are observed.

As the externally added amount of the agent improving the transfer efficiency increases, the phenomenon of a decrease of the toner flowability occurs. Thus, as shown in Example 6, the concurrent use of inorganic fine powders, such as a hydrophobic silica fine powder and an aluminum oxide fine powder in combination, is effective for maintaining the toner flowability.

To compare the intensity of the effect depending on the dimension of the average particle size of an agent improving the transfer efficiency, experiments are conducted as shown in Comparative Examples 1 and 2.

Comparative Example 1

Three parts by weight of an agent improving the transfer efficiency, namely a polymethyl methacrylate fine powder surface treated with a metal salt and having an average particle size of 3.5 μm and 1 part by weight of a hydrophobic silica fine powder of an average particle size of 10 to 20 nm, are mixed with 100 parts by weight, before the external addition, of the toner particle of the composition described above, followed by agitation with a Henschel mixer to prepare a developer. Subsequently under the conditions described above, printing is done onto the recording medium 12 to measure the transfer efficiency and the fogging index.

Results of measurement

Transfer efficiency: 70%

Fogging index: 0.52

Comparative Example 2

Three parts by weight of an agent improving the transfer efficiency, namely a polymethyl methacrylate fine powder surface treated with a metal salt and having an average particle size of 0.07 μm and 1 part by weight of a hydrophobic silica fine powder of an average particle size of 10 to 20 nm, are mixed with 100 parts by weight, before the external addition, of the toner particle of the composition described above, followed by agitation with a Henschel mixer to prepare a developer. Subsequently under the conditions described above, printing is done onto the recording medium 12 to measure the transfer efficiency and the fogging index.

Results of measurement

Transfer efficiency: 67%

Fogging index: 0.32

As shown above, a lower transfer efficiency than those in Examples 1 to 9 is brought about when the average particle size of an agent improving the transfer efficiency such as an acrylic fine powder is outside the range of about 0.1 to about 3.0 μm. Nevertheless, relatively better results are shown compared with the developer containing no agent improving the transfer efficiency. No reduction of the effect against fogging is observed.

A developer containing an agent improving the transfer efficiency at less than 1 part by weight to 100 parts by weight of a toner, which developer is described in Japanese unexamined Patent Publication 4-280254, is now evaluated.

Comparative Example 3

0.5 part by weight of an agent improving the transfer efficiency, namely a polymethyl methacrylate fine powder surface treated with a metal salt and having an average particle size of 0.15 μm and 1 part by weight of a hydrophobic silica fine powder of an average particle size of 10 to 20 nm, are mixed with 100 parts by weight, before the external addition, of the toner particle of the composition described above, followed by agitation with a Henschel mixer to prepare a developer. Subsequently under the conditions described above, printing is done onto the recording medium 12 to measure the transfer efficiency and the fogging index.

Results of measurement

Transfer efficiency: 65%

Fogging index: 1.46

No substantial change is observed between the developer containing no agent improving the transfer efficiency and a developer containing an agent improving the transfer efficiency but added outside a range of 1 part by weight or more to 100 parts by weight of the toner. That is, the transfer efficiency of the Comparative Example 3 developer is lower than those of Examples 1 to 9. This is also true regarding fogging.

The experimental examples described above are representative examples of the invention, wherein the invention is more specifically embodied. Various modifications, variations and improvements thereof can be made on the basis of the knowledge of a person skilled in the art, without departing from the spirit of the invention.

Regarding the method for coating the additive agents upon the surface of the toner particles, an agent improving the transfer efficiency and an inorganic fine powder may be added simultaneously, but another method may be used, comprising adding an agent improving the transfer efficiency to a toner while additionally supplying the toner, to carry out uniform and homogeneous dispersion and addition, followed by addition of an inorganic fine powder to possibly attain better results. Better results may also possibly be brought about by additionally supplying the toner to both of the agent improving the transfer efficiency and the inorganic fine powder so as to carry out the addition.

What is claimed is:

1. An electrostatic latent image developer for use in a non-magnetic one-component developing method for developing an electrostatic image into a visible image with a toner, comprising toner, an agent improving transfer efficiency on the surface of the toner, wherein said agent improving transfer efficiency is added in an amount of one or more parts by weight based on 100 parts by weight of the toner and is surface treated with a metal salt, a first aluminum oxide fine powder on the surface of the toner, wherein said first aluminum oxide fine powder has an average particle size of 8 to 18 nm and added to the toner in an amount of about 0.1 to about 1 parts by weight to 100 parts by weight of the toner, and a second aluminum oxide fine powder on the surface of the toner, wherein said second aluminum oxide fine powder has an average particle size of 0.3 to 10 μm and added to the toner in an amount of about 0.1 to about 1 parts by weight to 100 parts by weight of the toner.

2. An electrostatic latent image developer according to claim 1, wherein the agent improving transfer efficiency has an average particle size of about 0.1 to about 3 μm.

3. An electrostatic latent image developer according to claim 2, wherein the agent improving the transfer efficiency is selected from the group consisting of an acrylic polymer fine powder, a vinyl polymer fine powder, a styrene polymer fine powder, a powder of a copolymer of two or more monomers used as starting materials for generating these polymeric fine powders, and a powder of mixtures thereof.

4. An electrostatic latent image developer according to claim 1, wherein a hydrophobic silica fine powder having a BET specific surface area of 50 to 300 $m^2/g$ is added on the surface of the toner in an amount of about 0.3 to about 5 parts by weight to 100 parts by weight of the toner.

5. An electrostatic latent image developer according to claim 1, wherein the toner further comprises a toner binder, pigment, optional mold releasing agents and optional charge control agents.

6. An electrostatic latent image developer for use in a non-magnetic one-component developing method for developing an electrostatic image into a visible image with a toner, comprising toner, an agent improving transfer efficiency selected from the group consisting of an acrylic polymer fine powder, a vinyl polymer fine powder, a styrene polymer fine powder, a fine powder of a copolymer of two or more monomers used as starting materials for generating these polymeric fine powders, and a powder of mixtures thereof, having an average particle size of 0.1 to 3 μm on the surface of the toner in an amount of 1 part by weight or more to 100 parts by weight of the toner and wherein the agent improving transfer efficiency is surface treated with a metal salt, an aluminum oxide fine powder having an average particle size of 0.3 to 10 μm on the surface of the toner in an amount of 0.1 to 1 parts by weight to 100 parts by weight of the toner, an aluminum oxide fine powder having an average particle size of 8 to 18 nm on the surface of the toner in an amount of about 0.1 to about 1 parts by weight to 100 parts by weight of toner, and a hydrophobic silica fine powder having a BET specific surface area of 50 to 300 $m^2/g$ on the surface of the toner in an amount of about 0.3 to about 5 parts by weight to 100 parts by weight of the toner.

7. A method for improving transfer efficiency of a toner from a photosensitive material to a recording medium in a non-magnetic one-component developing process, comprising developing an electrostatic latent image on the photosensitive material with a developer comprising a toner, an agent improving transfer efficiency on the surface of the toner in an amount of 1 part by weight or more to 100 parts by weight of toner, wherein the agent improving transfer efficiency is surface treated with a metal salt, a first aluminum oxide fine powder having an average particle size of 8 to 18 nm on the surface of the toner in an amount of about 0.1 to about 1 parts by weight to 100 parts by weight of the toner, and a second aluminum oxide fine powder having an average particle size of 0.3 to 10 μm on the surface of the toner in an amount of about 0.1 to about 1 parts by weight to 100 parts by weight of the toner, and transferring said developed image to the recording medium.

8. A method according to claim 7, wherein following said transferring, the photosensitive material is not cleaned.

9. A method according to claim 7, wherein said developer further comprises a hydrophobic silica fine powder having a BET specific surface area of 50 to 300 $m^2/g$ on the surface of the toner.

10. A method according to claim 7, wherein the agent improving transfer efficiency has an average particle size of about 0.1 to about 3 μm.

11. A method according to claim 10, wherein said agent improving transfer efficiency is selected from the group consisting of an acrylic polymer fine powder, a vinyl polymer fine powder, a styrene polymer fine powder, a powder of a copolymer of two or more monomers used as starting materials for generating these polymeric fine powders, and a powder of mixtures thereof.

* * * * *